US010301097B2

(12) United States Patent
Groff et al.

(10) Patent No.: US 10,301,097 B2
(45) Date of Patent: May 28, 2019

(54) SHIPPING CONTAINER FOR PACKAGING FRANGIBLE PRODUCTS

(71) Applicant: INTERNATIONAL PAPER COMPANY, Memphis, TN (US)

(72) Inventors: Trevor James Groff, North Canton, OH (US); Waylande Juan Sanchez, Rittman, OH (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 17 days.

(21) Appl. No.: 15/443,650

(22) Filed: Feb. 27, 2017

(65) Prior Publication Data

US 2017/0362010 A1 Dec. 21, 2017

Related U.S. Application Data

(60) Provisional application No. 62/300,107, filed on Feb. 26, 2016.

(51) Int. Cl.

| | |
|---|---|
| ***B65D 81/05*** | (2006.01) |
| ***B65D 25/10*** | (2006.01) |
| ***B65D 85/62*** | (2006.01) |
| ***B65D 77/04*** | (2006.01) |
| ***B65D 5/50*** | (2006.01) |
| *B65D 85/30* | (2006.01) |
| *B65D 81/127* | (2006.01) |

(52) U.S. Cl.

CPC ..... *B65D 81/052* (2013.01); *B65D 5/5035* (2013.01); *B65D 25/107* (2013.01); *B65D 77/042* (2013.01); *B65D 81/05* (2013.01); *B65D 85/62* (2013.01); *B65D 81/1275* (2013.01); *B65D 85/30* (2013.01); *B65D 2581/053* (2013.01); *B65D 2585/643* (2013.01)

(58) Field of Classification Search

CPC ..... B65D 2581/053; B65D 2581/642; B65D 2581/643; B65D 5/445; B65D 5/5035; B65D 5/5064; B65D 5/5066; B65D 5/5076; B65D 5/508; B65D 5/556; B65D 77/0413; B65D 81/05; B65D 81/07; B65D 81/127

USPC ..... 229/120.36, 120.38, 122.32, 122.34

See application file for complete search history.

(56) References Cited

U.S. PATENT DOCUMENTS 1,568,033 A * 12/1925 Beecher ..... B65D 81/05 206/518
1,840,677 A * 1/1932 Miessler ..... B65D 5/5035 206/521
2,149,720 A * 3/1939 Becker ..... B65D 5/12 229/122.3
2,606,709 A * 8/1952 Carey ..... B65D 5/323 229/117.12
2,731,189 A * 1/1956 Moore ..... B65D 3/08 229/106
2,851,208 A * 9/1958 Samsing ..... B65D 5/324 229/122.23

(Continued)

*Primary Examiner* — Mollie Impink
(74) *Attorney, Agent, or Firm* — Thomas W. Ryan; Michael D. Folkerts

(57) ABSTRACT

The purpose of the claimed invention is to have a protective internal structure using multiple corrugated paperboard inserts that will fit into a RSC (regular slotted container) case. These inserts and the internal structure that it creates, enable a user to ship their product via common or contract carrier without damage to the user's product.

15 Claims, 8 Drawing Sheets

(56) References Cited

U.S. PATENT DOCUMENTS

| | | | | | |
|---|---|---|---|---|---|
| 2,893,617 | A * | 7/1959 | George | B65D 5/566 | 206/521.1 |
| 3,119,542 | A * | 1/1964 | Pomerantz | B65D 5/5045 | 206/585 |
| 4,574,998 | A * | 3/1986 | Vavra | B65D 77/0433 | 206/320 |
| 5,417,342 | A * | 5/1995 | Hutchison | B65D 5/68 | 229/122.32 |
| 9,221,577 | B2 * | 12/2015 | Curtis | B65D 5/505 | |
| 2007/0051787 | A1 * | 3/2007 | Schille | B65D 81/3858 | 229/122.32 |

* cited by examiner

SHIPPING CONTAINER FOR PACKAGING FRANGIBLE PRODUCTS

FIELD OF THE INVENTION

This invention relates generally to shipping containers, and more particularly to a shipping container having inserts for supporting and holding frangible products during shipment.

BACKGROUND AND SUMMARY OF THE INVENTION

Shipping and distribution of frangible products, such as porcelain toilets, bathtubs and sinks, often require customized packaging. Proper packaging of the frangible products ensures the efficient, economical, and safe delivery of products through various distribution channels. It is always desirable to have an inexpensive container suitable for packaging large, bulky items, such as toilets, sinks, bathtubs, and the like. Suitable containers for such large, bulky items have typically been rather expensive due to the high storage characteristics necessary to contain such products. In general, toilets, sinks, bathtubs, for example, have been shipped in heavy wooden crates which were reinforced by means of wooden or metal support inserts. This wooden container reinforced with wooden or metal inserts are very heavy, difficult to handle, and expensive due to the material cost and the assembly time involved.

Therefore, there is a need to provide an inexpensive, lightweight container formed entirely from corrugated paperboard which is adapted for packaging and shipping large, bulky and frangible items such as toilets, sinks, bathtubs, and the like.

The purpose of the claimed invention is to have a protective internal structure using multiple corrugated paperboard inserts that will fit into a RSC (regular slotted container) case. These inserts and the internal structures create and enable a user to ship their product via common or contract carrier without damage to the user's product.

The structure of the invention comprises of three separate insert blank forms that are formed and/or placed into a RSC case or master shipper to form a protective internal structure. The first insert defines by blank B2 is folded along the perforation at 90 degrees to form a U-shaped configuration. The perforation and score lines on the outer most edges are then folded up and locked in to form rectangular air cells along the top sides as shown in FIG. 9. The second insert defines by blank B3 is also folded or formed in a similar manner as shown in FIG. 9. After first and second inserts have been constructed, the second insert is slid over the first insert and they are locked together using angled tapered slots to define a protective air cell. The protective air cell forms a structure that includes a tapered body in the RSC case or container and forms additional supporting air cells on the upper part of the inserts as shown in FIG. 6. There are two identical third insert blanks B4 each of which is formed by folding depending flanges along the perforations and each of which is disposed in the respective top and bottom of the RSC case. The RSC case is constructed from a blank B1 formed and sealed along the bottom flaps. One of the third inserts is then placed in the bottom of the RSC case or master shipper with the depending flanges facing down as shown in FIG. 2. Next, the protective air cell is disposed inside of the interior space of the RSC case or master shipper as depicted in FIG. 3. In the particular example, the product is a toilet, but not limited to such item, is then placed into the protective air cell and seated properly into place as shown in FIG. 4. The other third insert is then placed on top with the flanges facing up as shown in FIG. 5. The top flaps of the RSC case or master shipper are then closed and sealed and the product is ready for shipping.

The combination of the inserts and the RSC case is used to securely hold the product in place during the shipping. The tapered design of the protective air cell allows the bottom narrow portion of the product to fit securely into a square-shaped that is formed by the protective air cell. This portion of the design enables the product to be fully supported and does not allow the bottom portion of the product to shift during shipping. This lower portion of the design also creates an air cell that cushions the product if it is dropped. Additionally, the tapered-shaped of the protective air cell permits a user to maintain this air cell the entire height of the product when it is packed. This tapered-shaped also permits full support and protection of the product the entire height of the RSC case or master shipper. Furthermore, four additional air cells are formed on the upper of the tapered feature to create additional protection. The two identical third inserts are added to provide additional top and bottom support for the product so that the protective internal structure will protect the product no matter what face, edge or corner it is dropped on during shipping and transportation.

One of the important aspects of the invention is the fact that a full supportive air cell is constructed that surrounds the product and fully supports the product from the narrowest feature to the widest feature of the product. This holds the product in place, and decreases the chances of damage due to shifting and the breaking down of air cells because of additional forces that can be created if the product is not fully supported.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
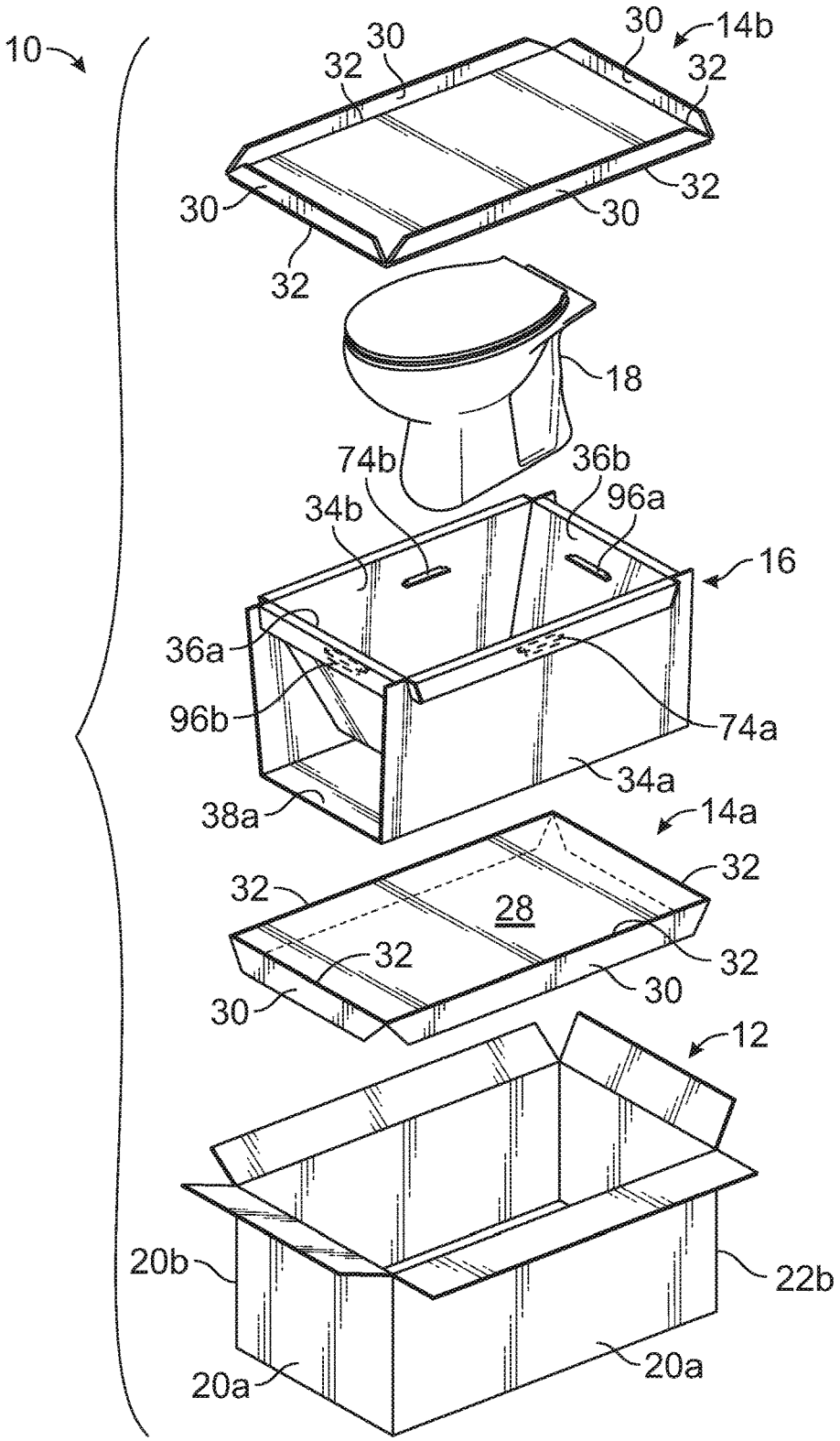
FIG. 1 is an exploded top perspective view of a shipping container for packaging frangible product having a RSC case, a bottom support insert, a protective air cell, and a top support insert wherein all of them are in a spaced relationship with one another in accordance to the invention.
Figure 2:
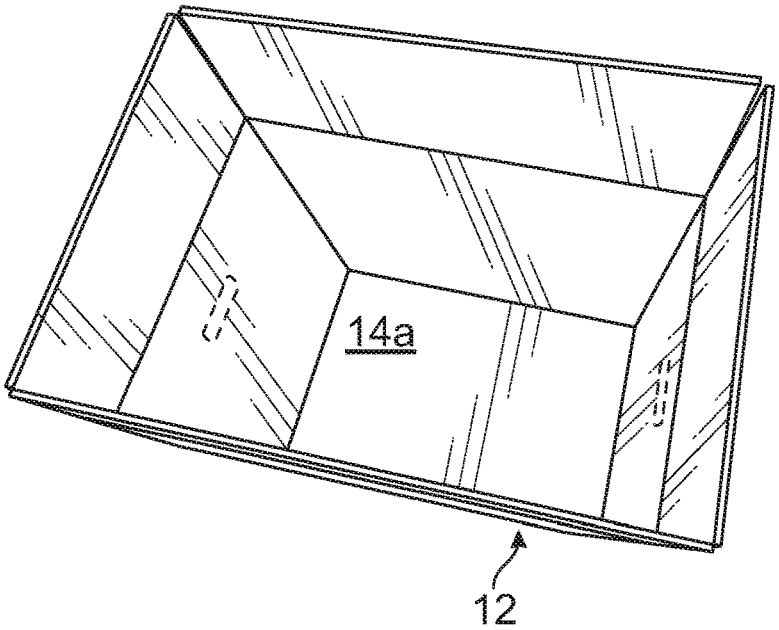
FIGS. 2-5 illustrate the manner in which each of the various inserts is placed inside the RSC case as depicted in FIG. 1 in accordance to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

FIG. 1 is an exploded perspective view of a shipping container 10 and comprises a RSC (regular slotted container) case 12, a bottom support insert 14*a*, a protective air cell 16, a product 18, and a top support insert 14*b* all of which are in a spaced-apart relationship with one another in accordance to the invention. As an example, the product 18 is a toilet, but not limited to, configured to be positioned inside the shipping container 10 and securely held therein by the protective air cell 16. One aspect of the invention is to have a protective internal structure using multiple corrugated paperboard inserts that will fit into a RSC case 12. These inserts and the internal structures that it forms, enable a user to ship their product via common or contract carrier without damage to the user's product. The RSC case 12 includes a rectangular parallelepiped having opposite side walls 20*a* and 20*b*, end walls 22*a* and 22*b*, and top and bottom walls 24 and 26, respectively. The respective top and bottom wall 24, 26 is defined by major and minor bottom flaps as will be discussed hereinafter. Regular slotted containers (RSC) are well known in the art of shipping containers. The RSC is highly economical shipping container due to the fact that there is very little manufacturing waste. Further, due to its rectangular shape it is well suited to shipping products via cargo container, truck, train, or any other means of transport in which efficient use of space is a priority. As a result, RSC is widely used for shipping and storing many different types of products.

The RSC 12 is formed from a single rectangular blank, typically of corrugated paperboard and have four rectangular sidewall panels. The RSC container has flaps on both the top and bottom edges of the sidewalls. In order to erect this container from a rectangular blank, as is known in the art, four crush folds are made parallel to the depth of the container to define the four sidewall panels, and further crush folds are made parallel to the length and width of the container to define upper and lower flaps. This style of container is articulated by folding along the crush folds so that the sidewall panels are disposed at right angles to one another and the flap panels are folded inwardly to close the top and bottom of the RSC with the flaps associated with the shorter sides of the container being folded inwardly first, followed by the flaps associated with the longer sides. The flaps are then secured in closed position by any suitable means, such as tape, adhesive, staples, etc. The bottom side of RSC typically is closed first, the desired products are then inserted into the container, and the top side is then closed.

Each of the respective top and bottom support insert 14*a*, 14*b* includes a central panel 28 having four depending flanges 30 each of which extends foldably extend thereof via fold lines 32. As an example of FIG. 1, the bottom support insert 14*a* has the four flanges 30 facing down so as to be place in the bottom of the RSC case 12. The top and bottom support inserts 14*a*, 14*b* have length and width that correspond to the length and width of the RSC case 12. However, the top support insert 14*b* has the four flanges 30 facing up so as to be place on top of the product before the RSC case 12 is enclosed. Each of the respective top and bottom support insert 14*a*, 14*b* is constructed from two identical inserts and defined as a third insert 14.

Figure 3:
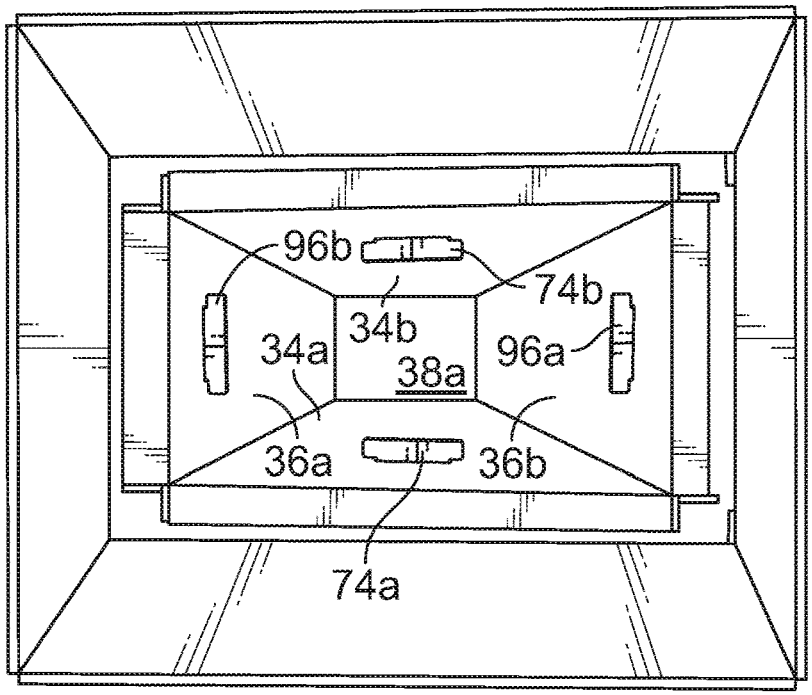

The protective air cell 16 includes four side walls 34*a*, 34*b*, 36*a*, 36*b* and a bottom wall 38*a* that are engaged with one another. The protective air cell 16 is constructed from first and second inserts 16*a*, 16*b* that are engaged with one another and will be discussed in greater detail hereinafter. After the first and second inserts 16*a*, 16*b* have been constructed, the second insert 16*b* is slid over the first insert 16*a* and they are locked together using angled tapered slots 64*a*, 64*bb*, 64*c*, 64*d*, 86*a*, 86*b*, 86*c*, and 86*d*. The two inserts 16*a*, 16*b* form a structure that includes a tapered body that ultimately forms a protective air cell 16 in the RSC case or container 12 and forms additional supporting air cells on the upper part of the inserts as shown in FIG. 3. The product 18 is a toilet that is securely held by the protective air cell 16 inside the shipping container 10. The top support insert 14*b* is placed on top of the product 18 and the top wall 20 encloses the shipping container 10. To assemble the shipping container 10, the bottom support insert 14*a*, with the flanges 30 facing down, is disposed in the bottom of the RSC case 12 and then the protective air cell 16 is positioned in the interior space of the RSC case 12. Next, the product 18, a toilet in this example, fits inside the RSC care 12 and is securely held by the protective air cell 16 so that the product 18 is fully supported and does not allow the bottom portion of the product to shift during shipping. When the toilet is placed inside the protective air cell 16, the locking tabs on the protective air cell 16 further helps to prevent the toilet from any movement in the shipping container. This lower portion of the shipping container 10 also creates an air cell that cushions the product 18 if it is accidentally dropped during transportation. Finally, to further protect the product 18, the top support insert 14*b* is placed on top of the product and the shipping container 10 is enclosed.

Figure 6:
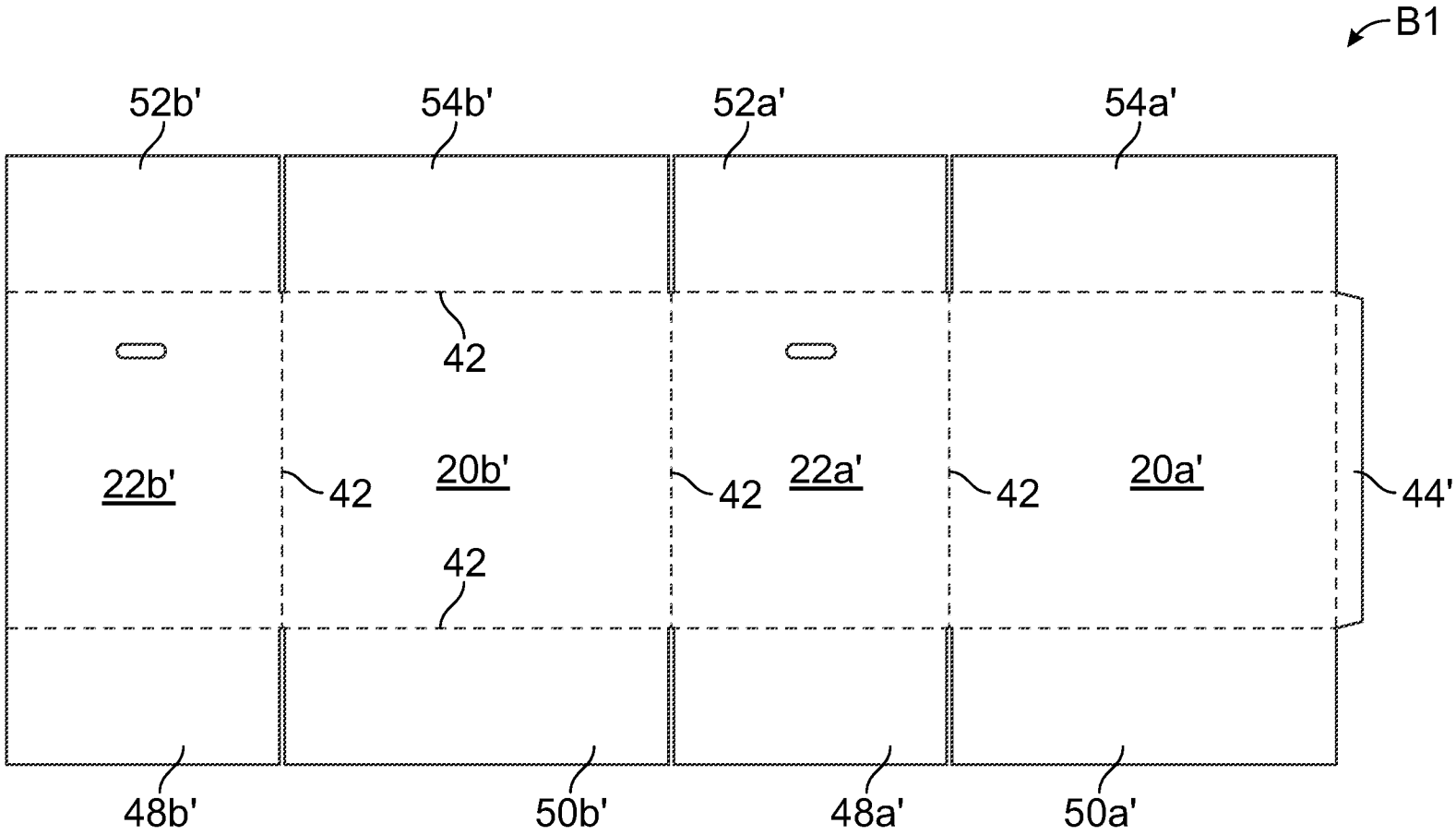
FIG. 6 is a top plan view of a blank B1 for making the RSC case shown in FIG. 1.
Figure 4:
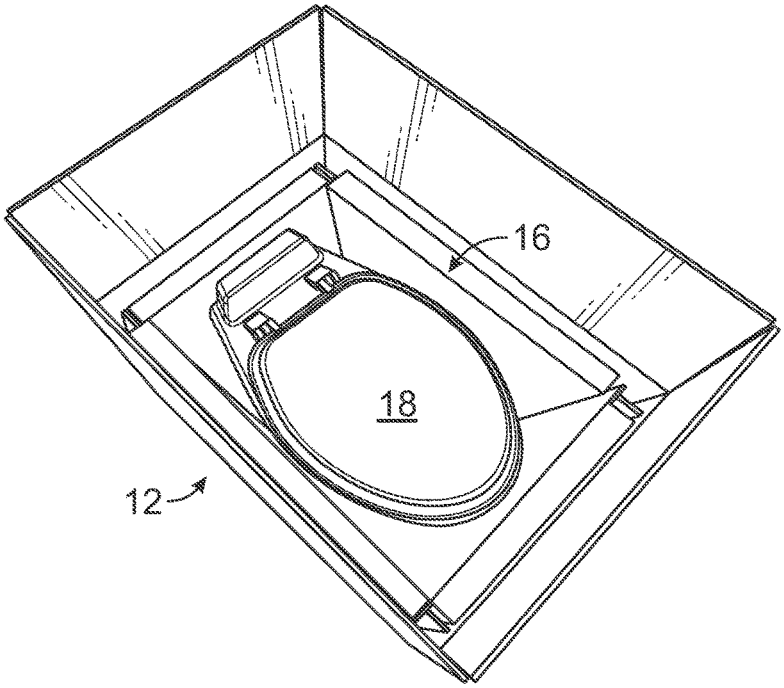
Figure 5:
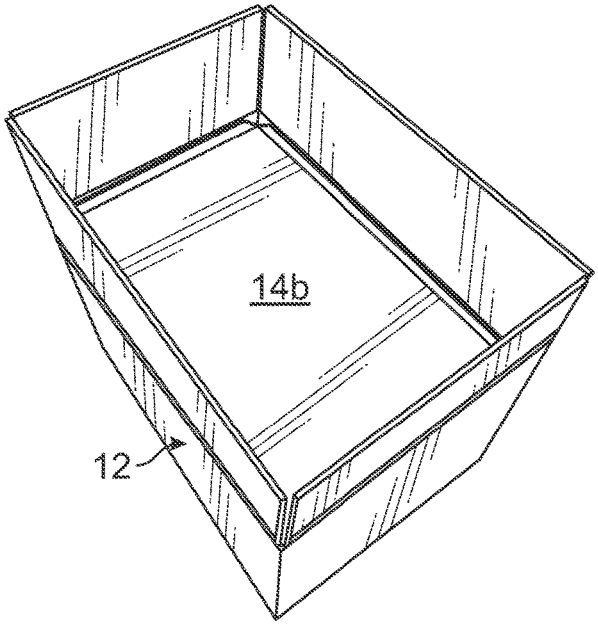

FIG. 6 is a top plan view of a blank B1 for making the RSC case 12 shown in FIG. 1. The blank B1 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank B1 is cut and scored, perforated or otherwise formed to include a plurality of panels that when assembled form the shipping container 10. A series of fold scores 42 in the blank B1 define a first side wall panel 20*a*' at a first end of the blank B1, a first end wall panel 22*a*' adjoining the first side wall panel 20*a*', a second side wall panel 20*b*' adjoining the first end wall panel 22*a*' along an edge opposite that edge joined to the first side wall panel 20*a*', and a second end wall panel 22*b*' adjoining the second side wall panel 20*b*' along the edge opposite the first end wall panel 22*a*'. A glue flap 44' is foldably joined to the edge of the first side wall panel 20*a*' opposite the edge joined to the first end wall panel 22*a*'. Minor bottom flaps 48*a*' and 48*b*' are foldably joined to bottom edges of the end wall panels 22*a*' and 22*b*', respectively, and major bottom flaps 50*a*' and 50*b*' are foldably joined to bottom edges of the side wall panels 20*a*' and 20*b*', respectively. Similarly, minor bottom flaps 52*a*' and 52*b*' are foldably joined to bottom edges of the end wall panels 22*a*' and 22*b*', respectively, and major bottom flaps 54*a*' and 54*b*' are foldably joined to bottom edges of the side wall panels 20*a*' and 20*b*', respectively. To construct the blank B1, the sidewall and end wall panels 20*a*', 20*b*' and 22*a*', 22*b*' are folded at right angles to one another and the minor and major bottom flap panels

50*a*', 50*b*' and 48*a*', 48*b*' are folded inwardly to close the bottom of the RSC case 12 with the flaps associated with the shorter sides of the container being folded inwardly first, followed by the flaps associated with the longer sides. The minor and major flaps are then secured in closed position by any suitable means, such as tape, adhesive, staples, and the like. The bottom side of RSC case 12 typically is closed first, the other inserts are then attached to the RSC and the desired product, such as toilet, for example, is placed into the container, and the top side is then closed.

Figure 7A:
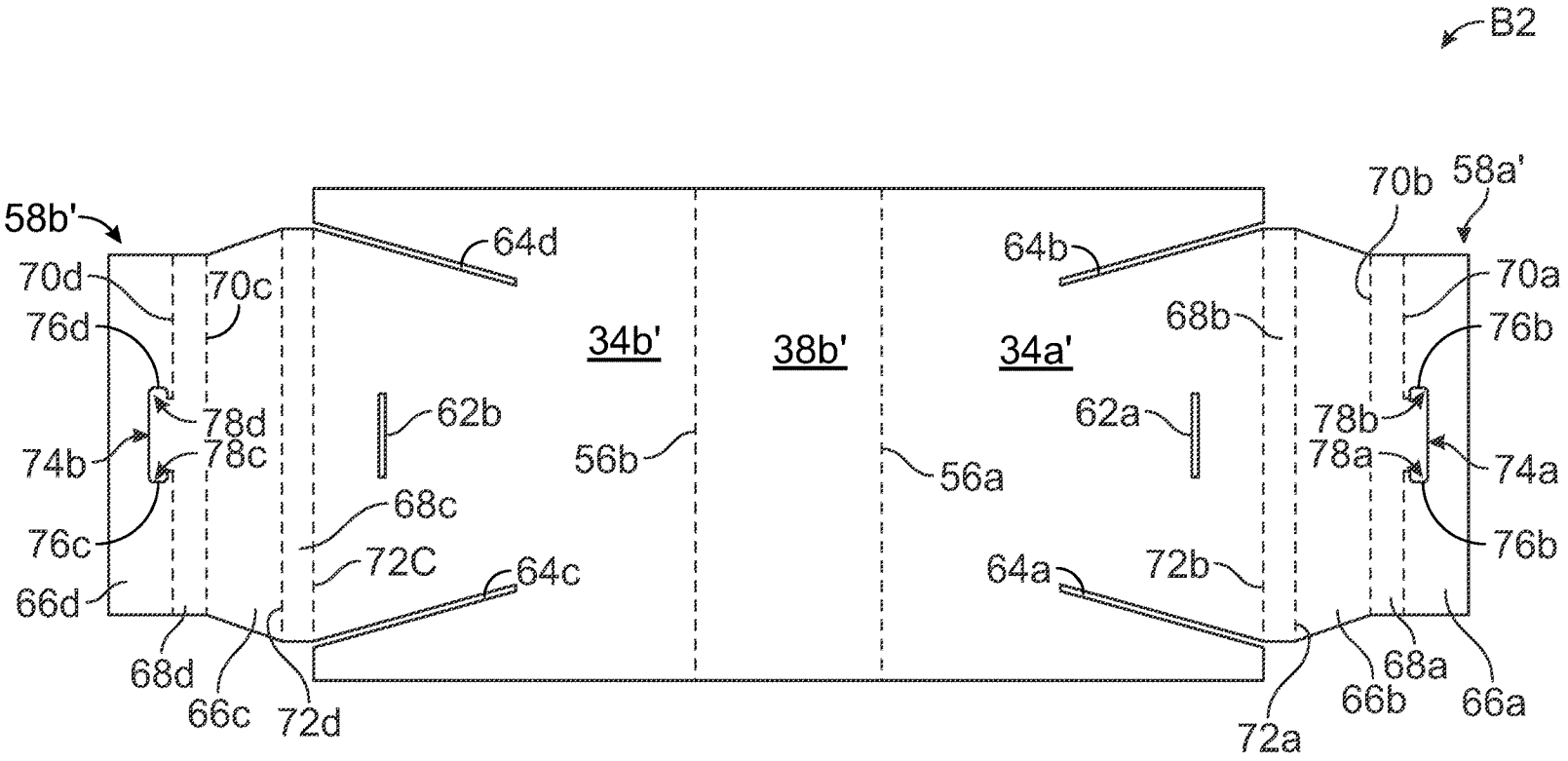
FIGS. 7A and 7B are a respective top plan view of a respective blanks B2 and B3 for making the protective air cell shown in FIG. 1.
Figure 7B:
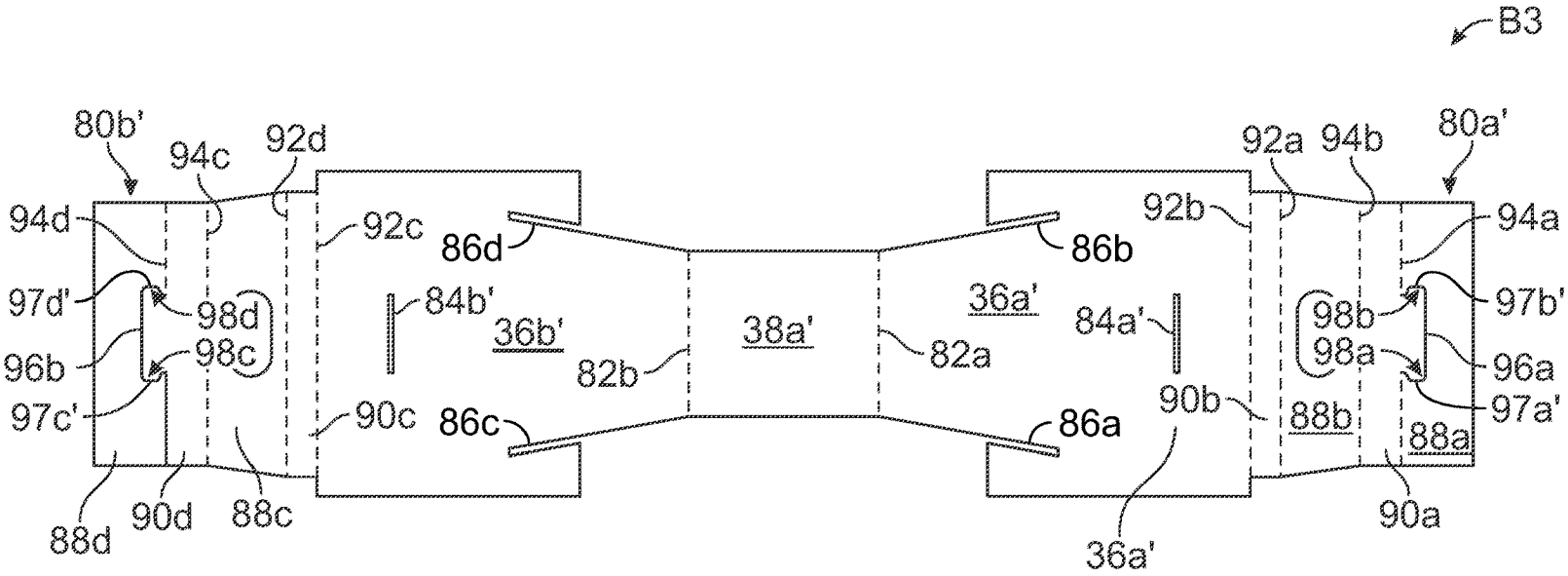

FIGS. 7A and 7B are a respective top plan view of respective blanks B2 and B3 for making the protective air cell 16 shown in FIG. 1. When constructed, each of the respective blank B2 and B3 defines by the first and second inserts 16*a*, 16*b*, respectively. Each of the blanks B2 and B3 is preferably an integral piece of a material such as continuous sheet of conventional corrugated paperboard. Each of the blanks B2 and B3 is cut along its outer margins to form its specific shape so that when the two blanks are locked together they correspond to the shape of the protective air cell 16. The blank B2 is divided into a bottom wall panel 38*b*' and two respective sidewalls panel 34*a*' and 34*b*' by two respective parallel fold lines 56*a* and 56*b*. The bottom wall panel 38*b*' is formed on the central portion of the blank B2 in which each of the sidewalls panel 34*a*' and 34*b*' is foldably joined therefrom its respective longitudinal edges. The blank B2 is symmetric with respect to a lateral axis and the two sidewalls panels 34*a*', 34*b*' are exactly the same and they are mirror image of one another. Each of the respective sidewalls panels 34*a*', 34*b*' includes a respective first and second air cell panels 58*a*', 58*b*' each of which foldably extends from the respective outer edges of the respective sidewalls panels 34*a*', 34*b*' by respective fold lines 72*b*, 72*c*. Each of the respective sidewalls panels 34*a*', 34*b*' includes a respective first slots 62*a* and 62*b* formed on the mid-portion close to the respective outer edges of the sidewalls panels 34*a*', 34*b*' for a purpose hereinafter described. Moreover, each of the respective sidewalls panels 34*a*', 34*b*' includes a respective pair of second angled slots 64*a*, 64*b* and 64*c*, 64*d* formed therein for a purpose hereinafter described. For example, each of the pair of second angled slots 64*a*', 64*b*' is formed from outer edge of the sidewall panel 34*a*' moving toward the mid-portion thereof such that the pair of second angled slots 64*a*', 64*b*' is converging to one another.

Figure 9:
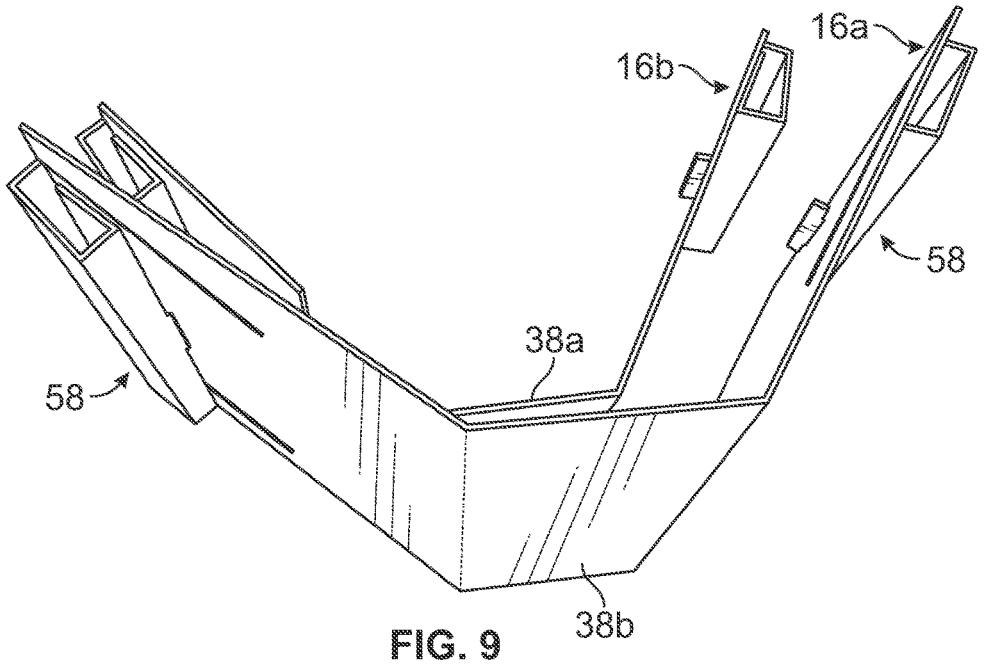
FIG. 9 is a respective top perspective view of the assembled blanks B2 and B3 shown in FIGS. 7A and 7B.
Figure 10:
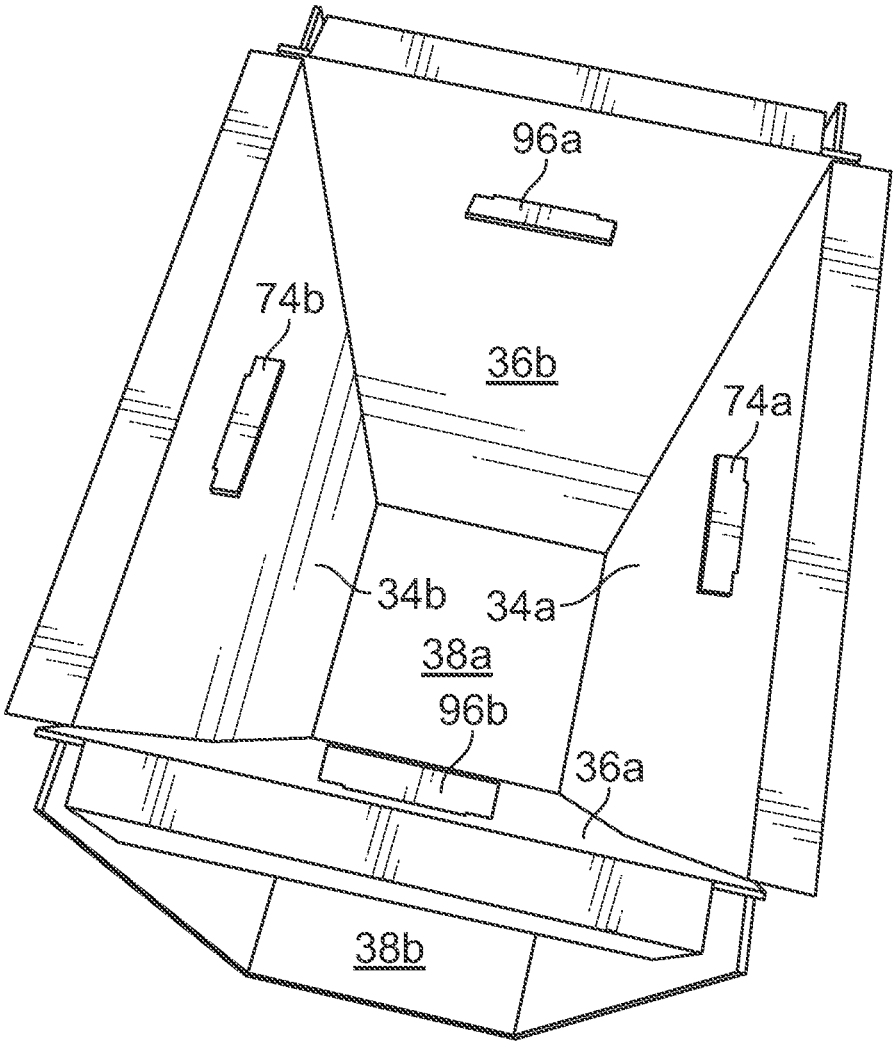
FIG. 10 is a top plan view of the protective air cell constructed from the two Blanks B2 and B3 in accordance to the invention.

Similarly, each of the pair of second angled slots 64*c*', 64*d*' is formed from outer edge of the sidewall panel 34*b*' moving toward the mid-portion thereof such that the pair of second angled slots 64*c*', 64*d*' are converging to one another. Furthermore, the first air cell panel 58*a*' includes an outer flap 66*a*, an inner flap 66*b*, and two side flaps 68*a*', 68*b*' defined by parallel fold lines 70*a*, 70*b* and 72*a*, 72*b*. When the first air cell panel 58*a*' is fully constructed, it forms an air cell 58 as seen best in FIG. 9. The outer flap 66*a*' and the inner flap 66*b*' are foldably separated by a side flap 68*a*' and the inner flap 66*b*' is foldably joined to the side wall panel 34*a*' via side flap 68*b*'. A locking tab 74*a*' is formed in the mid portion of the outer flap 66*a*' closely adjacent the fold line 70*a* so as to engage with the first slot 62*a*' as will be described in greater detail hereinafter. The locking tab 74*a*' includes two locking ears 76*a*', 76*b*' on opposed ends thereof and formed by short scores 78*a*, 78*b* which are used to securely hold the locking tab 74*a* into the first slot 62*a*. The second air cell panel 58*b*' includes an outer flap 66*c*', an inner flap 66*d*', and two side flaps 68*c*', 68*d*' defined by parallel fold lines 70*c*, 70*d* and 72*c*, 72*d*. The outer flap 66*c*' and the inner flap 66*d*' are foldably separated by a side flap 68*c*' and the inner flap 66*c*' is foldably joined to the side wall panel 34*b*' via side flap 68*c*'. Similarly, a locking tab 74*b*' is formed in the mid portion of the outer flap 66*d*' closely adjacent the fold line 70*d* so as to engage with the first slot 62*b*' as will be described in greater detail hereinafter. The locking tab 74*b*' includes two locking ears 76*c*', 76*d*' on opposed ends thereof and formed by short scores 78*c*, 78*d* which are used to securely hold the locking tab 74*b*' into the first slot 62*b*'.

The blank B3 is divided into a bottom wall panel 38*a*' and two respective endwalls panels 36*a*', 36*b*' by two respective parallel fold lines 82*a*, 82*b*. The bottom wall panel 38*a*' is formed on the central portion of the blank B3 in which each of the end walls panels 36*a*' and 36*b*' is foldably joined therefrom its respective longitudinal edges. The blank B3 is symmetric with respect to a lateral axis and the two endwalls panels 36*a*', 36*b*' are exactly the same and they are mirror image of one another. Each of the respective sidewalls panels 34*a*', 34*b*' includes a respective third and fourth air cell panels 80*a*', 80*b*' each of which foldably extends from the respective outer edges of the respective endwalls panels 36*a*', 36*b*' by respective fold lines 82*a*, 82*b*. Each of the respective endwalls panels 36*a*', 36*b*' includes a respective third slots 84*a*' and 84*b*' formed on mid-portion close to the respective outer edges of the endwalls panels 36*a*', 36*b*' for a purpose hereinafter described. Moreover, each of the respective endwalls panels 36*a*', 36*b*' includes a respective pair of fourth angled slots 86*a*', 86*b*' and 86*c*', 86*d*' formed therein for a purpose hereinafter described. For example, each of the pair of fourth angled slots 86*a*', 86*b*' is formed from outer edge of the endwall panel 36*a*' moving away from the mid-portion thereof such that the pair of fourth angled slots 86*a*', 86*b*' is diverging to one another. Similarly, each of the pair of fourth angled slots 86*c*', 86*d*' is formed from outer edge of the endwall panel 36*b*' moving away the mid-portion thereof such that the pair of fourth angled slots 86*c*', 86*d*' are diverging to one another. Furthermore, the third air cell panel 80*a*' includes an outer flap 88*a*', an inner flap 88*b*', and two side flaps 90*a*', 90*b*' defined by parallel fold lines 92*a*, 92*b* and 94*a*, 94*b*. The outer flap 88*a*' and the inner flap 88*b*' are foldably separated by a side flap 90*a*' and the inner flap 88*b*' is foldably joined to the end wall panel 36*a*' via side flap 90*b*'. A locking tab 96*a*' is formed in the mid portion of the outer flap 88*a*' closely adjacent the fold line 94*a*' so as to engage with the third slot 84*a*' as will be described in greater detail hereinafter. The locking tab 96*a*' includes two locking ears 97*a*', 97*b*' on opposed ends thereof and formed by short scores 98*a*', 98*b*' which are used to securely hold the locking tab 96*a* into the third slot 84*a*'. The fourth air cell panel 80*b*' includes an outer flap 88*c*', an inner flap 88*d*', and two side flaps 90*c*', 90*d*' defined by parallel fold lines 92*c*, 92*d* and 94*c*, 94*d*. The outer flap 88*d*' and the inner flap 88*c*' are foldably separated by a side flap 90*d*' and the inner flap 88*c*' is foldably joined to the side wall panel 36*b*' via side flap 90*c*'. Similarly, a locking tab 96*b*' is formed in the mid portion of the outer flap 88*d*' closely adjacent the fold line 94*d*' so as to engage with the fourth slot 84*b*'. The locking tab 96*b*' includes two locking ears 97*c*', 97*d*' on opposed ends thereof and formed by short scores 98*c*', 98*d*' which are used to securely hold the locking tab 96*b*' into the fourth slot 84*b*'.

To construct the blank B2, the two sidewalls panels 34*a*' and 34*b*' are simultaneously folded up at right angle via fold lines 56*a*, 56*b*. Next, the respective first and second air cell panels 58*a*', 58*b*' are formed into rectangular air cells by first folding the respective outer flaps 66*a*', 66*d*' via respective fold lines 70*a*, 70*d* and continue folding the outer flaps 66*a*', 66*d*' via fold lines 70*b*, 70*c* so the outer flaps 66*a*', 66*c*' and the inner flaps 66$b'$, 66$d'$ are in parallel with one another and spaced apart by the respective side flaps 68$a'$, 68$b'$ and 68$c'$, 68$d'$. Finally, by pressing the respective locking ears 76$a'$, 76$b'$ and 76$c'$, 76$d'$ inwardly, the respective locking tabs 74$a'$, 74$b'$ are inserted into the respective first slots 62$a'$, 62$b'$ so that the locking ears 76$a'$, 76$b'$ and 76$c'$, 76$d'$ prevent the locking tabs 74$a'$, 74$b'$ from popping out of the respective first slots 62$a'$, 62$b'$.

To construct the blank B3, the two sidewalls panels 36$a'$ and 36$b'$ are simultaneously folded up at right angle via fold lines 82$a$, 82$b$. Next, the respective first and second air cell panels 80$a'$, 80$b'$ are formed into rectangular air cells by first folding the respective outer flaps 88$a'$, 88$d'$ via respective fold lines 94$a$, 94$d$ and continue folding the outer flaps 88$a'$, 88$d'$ via fold lines 94$b$, 94$c$ so the outer flaps 88$a'$, 88$d'$ and the inner flaps 88$b'$, 88$d'$ are in parallel with one another and spaced apart by the respective side flaps 90$a'$, 90$b'$ and 90$c'$, 90$d'$. Finally, by pressing the respective locking ears 97$a'$, 97$b'$ and 97$c'$, 97$d'$ inwardly, the respective locking tabs 96$a'$, 96$b'$ are inserted into the respective first slots 84$a'$, 84$b'$ so that the locking ears 97$a'$, 97$b'$ and 97$c'$, 97$d'$ prevent the locking tabs 96$a'$, 96$b'$ from popping out of the respective first slots 84$a'$, 84$b'$.

As noted above, the protective air cell 16 is constructed from engaging first and second inserts 16$a$, 16$b$ formed by blanks B2 and B3. To assemble the protective air cell 16, second insert 16$b$ is slid over first insert 16$a$ and they are locked together using fourth angled slots 86$a$, 86$b$ and 86$c$, 86$d$ and second angled slots 64$a$, 64$b$ and 64$c$, 64$d$. The protective air cell 16 forms a structure that resemble a tapered body that creates the protective air cell 16 in the RSC case 12 and forms additional supporting air cells on the upper part of the insert. It should also be noted that any such elements or features of the protective air cell 16 can be implemented in a number of ways, as will be apparent to a person skilled in the art after reviewing the present disclosure, beyond any examples shown in this document.

Figure 8:
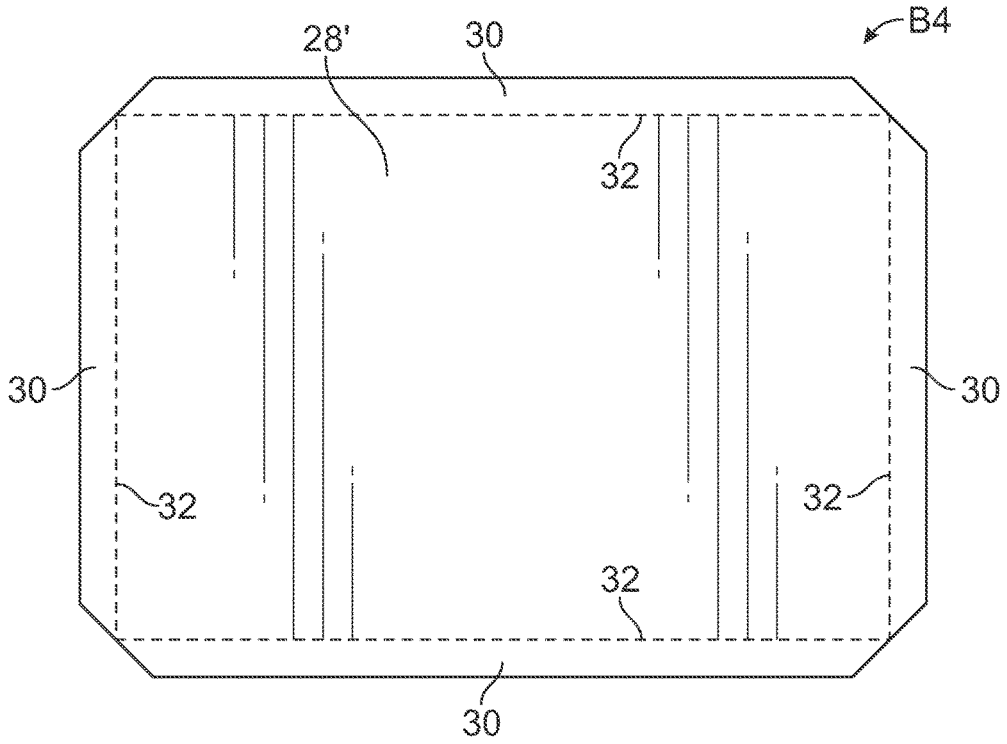
FIG. 8 is a top plan view of a blank B4 for making the respective top and bottom support insert shown in FIG. 1.

FIG. 8 is a top plan view of a blank B4 for making the respective top and bottom support insert shown in FIG. 1. The blank B4 includes a central panel 28' having four depending flanges 30' each of which extends foldably extend thereof via fold lines 32. In the preferred embodiment of the invention, the bottom support insert 14$a'$ is positioned inside the RSC case 12 such that the depending flanges 30' are facing down so that it provides further cushion for the product disposed therein. However, the top support insert 14$b'$ is positioned on top of the product 18 such that the depending flanges 30' are facing up before the container is enclosed for shipping and transportation.

While the invention has been described and illustrated with reference to one or more preferred embodiments thereof, it is not the intention of the Applicants that the invention be restricted to such detail. Rather, it is the intention of the Applicants that the invention be defined by all equivalents, both suggested hereby and known to those of ordinary skill in the art, of the preferred embodiments. For example, the protective air cell may be changed so that it contains different product so that the air cells or the size of the air cells may be changed so that it corresponds to the size of the product contained therein. Moreover, the geometry of the protective air cell may be changed so that it can carry variety of frangible products. The locking tabs and attachments of the panels to one another may configure differently so as to correspond to the retailer demands.

What is claimed is:

1. A shipping container system for packaging frangible products comprising:

a container having a bottom wall, a top wall and side walls;

a protective air cell for a product formed within the container by a space defined between a first insert and a second insert and the side walls of the container, each of said first and second inserts including a bottom wall and respective first and second sidewall panels foldably joined to the bottom walls;

said protective air cell further defined by a pair of third inserts, a first one of said third inserts placed within said container between the bottom wall of said container and the bottom wall of said inserts, and a second one of said third inserts placed between an upper part of the first and second inserts and the top wall of said container; and a pair of angled slots formed in each of the sidewall panels of the first and second inserts, wherein the angled slots formed in the sidewall panels of the second insert engage with the angled slots formed in the sidewall panels of the first insert.

2. The shipping container system as set forth in claim 1, wherein the first and second inserts each include side flaps foldably joined to the insert sidewall panels at the upper part of the first and second inserts to define a space between the insert sidewall panels and the container side walls.

3. The shipping container system as set forth in claim 1, wherein each of the third inserts is defined by a central panel and depending flanges extending parallel to the container side walls.

4. The shipping container system as set forth in claim 1, wherein the sidewall panels of the first insert taper outwardly from each other, extending upwardly from the bottom wall of the first insert, and the sidewall panels of the second insert taper outwardly from each other, extending upwardly from the bottom wall of the second insert.

5. The shipping container system as set forth in claim 1, wherein each of the first and second inserts are formed from a blank including a first sidewall panel, a bottom wall, and a second sidewall panel connected in series at respective parallel fold lines extending in a lateral direction of the blank.

6. The shipping container system as set forth in claim 5, wherein the lateral direction of the second insert is located transverse to the lateral direction of the first insert.

7. The shipping container system as set forth in claim 1, wherein the first and second inserts are formed of a paperboard material.

8. A shipping container system comprising:

a container having a bottom wall, a top wall, and side walls;

a first insert formed from a first blank including a first sidewall panel, a bottom wall, and a second sidewall panel connected in series at respective parallel fold lines extending in a lateral direction of the first blank, the first insert comprising the first and second sidewall panels extending upward from the bottom wall of the first insert and adjacent to opposing side walls of the container;

a second insert formed from a blank including a first sidewall panel, a bottom wall, and a second sidewall panel connected in series at respective parallel fold lines extending in a lateral direction of the second blank, the second insert comprising the first and second sidewall panels extending upward from the bottom wall of the second insert and adjacent to opposing side walls of the container;

a pair of angled slots formed in each of the sidewall panels of the first and second inserts, wherein the angled slots formed in the sidewall panels of the second insert engage with the angled slots formed in the sidewall panels of the first insert; and wherein the bottom wall of the second insert is positioned adjacent a downwardly facing side of the first insert, and the lateral direction of the second insert is located transverse to the lateral direction of the first insert.

9. The shipping container system as set forth in claim 8, Wherein the first and second sidewall panels of the first insert taper outward from each other in a direction from the bottom wall of the first insert.

10. The shipping container system as set forth in claim 9, Wherein the first and second sidewall panels of the second insert taper outward from each other in a direction from the bottom wall of the second insert.

11. The shipping container system as set forth in claim 8, including air cells formed at upper edges of at least one of the first and second inserts, wherein each air cell is defined by a plurality of flaps connected in series at respective parallel fold lines and foldably joined to a respective insert sidewall panel.

12. The shipping container system as set forth in claim 11, wherein each air cell is defined by folding the plurality of flaps to position an outer flap and an inner flap parallel to each other separated by a pair of side flaps to form a rectangular air cell.

13. The shipping container system as set forth in claim 11, wherein both of the first and second inserts include an air cell at an upper edge of each of the first and second sidewall panels of a respective insert.

14. The shipping container system as set forth in claim 8, including a pair of third inserts, a first one of the third inserts placed within the container between the bottom wall of the container and the bottom wall of the second insert, and a second one of the third inserts placed between part of the first and second inserts and the top wall of the container.

15. The shipping container system as set forth in claim 14, wherein each of the third inserts is defined by a central panel and depending flanges extending parallel to the container side walls.

* * * * *